United States Patent [19]

Kahlert et al.

[11] 4,059,061

[45] Nov. 22, 1977

[54] WASTE BURNER OVERFIRE DRAFT SYSTEM

[75] Inventors: George Kahlert; Lawrence Pommer, both of Prince George; John Davis; Bert Whebell, both of Houston, all of Canada

[73] Assignee: Northwood Pulp and Timber Limited, Prince George, Canada

[21] Appl. No.: 637,401

[22] Filed: Dec. 3, 1975

[51] Int. Cl.[2] ..... F23G 7/00; F23H 9/00

[52] U.S. Cl. ..... 110/7 A; 110/72 R; 110/72 B; 236/45

[58] Field of Search ..... 110/7 R, 7 A, 18 R, 110/72 R, 72 B, 163; 236/45

[56] References Cited

U.S. PATENT DOCUMENTS

| | | | |
|---|---|---|---|
| 2,692,640 | 10/1954 | Field | 236/45 |
| 2,801,056 | 7/1957 | Field | 236/45 |
| 3,638,591 | 2/1972 | Lausmann | 110/18 |
| 3,730,113 | 5/1973 | Stearns | 110/18 |
| 3,848,551 | 11/1974 | Cramer | 110/72 |

*Primary Examiner*—Kenneth W. Sprague
*Attorney, Agent, or Firm*—Fleit & Jacobson

[57] ABSTRACT

An overfire draft system for a waste burner is disclosed. Such system comprises air vents arranged circumferentially around the base of the burner for communicating the interior of the burner to the atmosphere and a draft modulated damper plate located in each air vent for automatically regulating the volume of overfire air delivered to the interior of the burner. Each draft modulated damper plate is provided with a lower lip which is deflected by a predetermined angle with respect to the plate to create an aerodynamic lift effect with large opening moment to assist the damper plate in its response under low air velocity conditions, and an oppositely deflected upper lip with proportionately less bent surface to avoid flutter or hunting of the damper as it approaches the maximum open position and to provide added dynamic opening force. The overfire draft system is also provided with ducts connected to the air vents and oriented so as to direct air tangentially around the base of the burner and toward the lower inside wall of the burner so as to minimize the disturbance of the inside air. The waste burner may also be provided with draft modulated or forced air vents arranged circumferentially at mid-elevation around the burner and duct means connected to such vents and directed at a small angle with the radius of the burner so as to cause turbulence in the flame zone and reduce the vertical velocity of gases above the fire, thus reducing emission of particulate materials. The waste burner may further be provided with a lip portion secured to the upper end thereof and extending toward the center of the burner for trapping the heavy particles entrained by hot gases and concentrated around the outside perimeter of the burner by the centrifugal forces generated by the usual rotational motion of such hot gases.

21 Claims, 7 Drawing Figures

WASTE BURNER OVERFIRE DRAFT SYSTEM

This invention relates to an overfire draft system for a sawmill waste burner.

Sawmill waste burners have been used for most of this century for burning wood wastes and bark residues. As commonly known, the typical sawmill waste burner is a conical or wigwam shaped burner consisting of a metal enclosure in the form of a truncated cone wherein wood wastes and bark residues are conveyed and dropped into a pile to be burnt. Underfire air is normally fed to the combustion zone through a grate structure placed in a pit at the base of the burner. Overfire air is also fed into the enclosure. However, for some reason, such burners have not evolved with a high degree of engineering control and this has resulted in excessive smoke and particulate emissions. Therefore, pressure from public environmental agencies has brought demands for improved waste burner operation, or their complete shut down.

Attempts have been made to modify the design of the waste burners so that objectionable smoke and particle emissions are reduced or eliminated. A study published by the Forest Research Laboratory or Oregon State University and entitled "Wood and Bark Residue Disposal in Wigwam Burners" (Bulletin 11, March 1970) describes various modifications which have been proposed to reduce air pollution. However, these various proposals have not been totally satisfactory and much work remains to be done towards the design of a pollution free burner.

More particularly, it has been found that exit gas temperatures in the range from 700° F to 900° F result in minimum emissions of smoke and particulate materials. To achieve this result, it has been proposed to control both the underfire and overfire air flow into the burner to maintain a total air input consistant with the maximum desired combustion temperature. Air flow control has been accomplished through air inlet dampers modulated by a temperature sensing device, such as a thermocouple, placed at the top of the burner to sense the exit gas temperature. However, thermocouples and their associated instrumentation systems are subject to malfunction or failure which could damage the burner or cause the smoke and particulate emissions.

Before proceeding with the description of the present invention, applicant would like to point out some of the basic facts concerning combustion. Combustion itself is the subject of a fairly exact science with three items being necessary for this to start: fuel, oxygen and heat. Once combustion has started, the characteristics of the firing depend on time, temperature and turbulence. Time is needed for the oxidation of the fuel, and with a solid fuel, the larger the particles, or mass of the particles, the longer the time it requires to burn, depending of course also on the other variables. Conversely, very small particles in suspension, such as sander dust, can have very fast, even explosive burning characteristics. This time is likely a function of mass to surface area ratio as well as thermal absorptivity. Temperature is of course required for combustion to continue, and low temperatures can result in smoke and excessive particle emissions. The thermal absorptivity is likely a forth power function of temperature differential. Turbulence is required to allow fuel molecules to meet and unite with oxygen molecules. Maximum turbulence is, however, not desirable everywhere as will be seen later in the description.

One more distinction is important. In all combustion of carbonaceous fuels, such as wood, two distinctive steps occur: primary combustion and secondary combustion. Primary combustion unites one atom of fuel carbon with one atom of oxygen to form one molecule of carbon monoxide (CO) gas. This step occurs by oxygen contacting the fuel solids and liberates about one-third of the total combustion heat. The chemistry is complex in that the primary and secondary reactions are reversible, but we consider the net effect here. Secondary combustion adds one more oxygen atom to the combustible CO gas, thereby forming the stable and well known carbon dioxide molecule ($CO_2$). This second step is basically a gaseous one, which need not occur in the vicinity of the actual wood fuel. It liberates about two-thirds of the total combustion heat. Again, as in primary combustion, carbon dioxide is stable when removed from the environment of fuel and only the net effect is considered here.

Before proceeding with the description of the invention applicant would also like to point out the wood fuel characteristics as related to waste burners. A sawmill waste burner is a garbage dump which is expected to consume this garbage as fast as it can be generated. An efficient burner must be able to consume this material efficiently no matter what its rate of flow, its physical characteristics, or its internal heat energy is. These characteristics can not be controlled, they can only be anticipated and allowed for. Nor are these characteristics stable for a given installation, as they can vary widely from hour to hour and from season to season. The design of a modern, pollution free, waste burner is, therefore, a difficult engineering challenge which demands the application of all possible ingenuity, particularly as this facility is also expected to be reasonably low in capital and operating costs. The extremes of the wood fuel which are of concern are:

1. Moisture Content

This moisture usually expressed as "dry basis" percentage can run from 15% to an extreme of about 200% at which point it becomes impossible to burn the wood without auxiliary fuel. Conservation of all possible heat is, therefore, essential with wet fuels. In addition, the fuel moisture may be in the form of ice which makes its heat demand even greater, and this ice must be melted. On the opposite end of the spectrum is the dry fuel, which is able to liberate tremendous heat, and the effective and automatic dissipation of this is essential.

2. Particle Size

This can vary from a fine often dry powder through flaky thin shavings, granular sawdust, to tough, stringy bark and large log chunks.

3. Fuel Flow Rates

These vary from zero during offshifts, coffee breaks, lunch hours, mill breakdowns, etc. through partial flows when only part of the plant is operating, to full extreme flows when everything can happen together.

A well designed burner should automatically and instantaneously adjust to these changing circumstances, while tending to maintain a constant exit gas temperature preferably around 800° F.

Under normal operating conditions, a pile of fuel is deposited in the center of the burner, and ventilation effected with underfire air. This brings oxygen in contact with carbon for the primary combustion step of forming CO gas. This CO gas can then escape the pile, and be burned in the space above the pile except in the case of very wet fuels which may require part of the heat of the secondary combustion within the fuel pile. Secondary or overfire air is furnished for the secondary combustion step and for the possible dilution of the mixture with more than the normal excess air. This extra air will have the effect of cooling the total mixture of gases.

In view of the above, the necessary measures to deal with extreme situations are as follows:

1. a. Extreme Fuel Wetness

Maximum pile ventilation by underfire air, and a nearly airtight burner enclosure are essential. Some benefits could be achieved by chamber insulation, refractory reflection, etc., but these are much more costly and of less consequence. Dead (non-turbulating) air is a good insulator in itself.

b. Extreme Fuel Dryness

Maximum enclosure ventilation is required, so that the heat can be literally flushed out. The burner shell is often sootted and scaly on the inside, weathered and rusty on the outside and in all is not a good conductor or radiator of heat.

2. a. Very Light Particles

Very light particles such as shavings tend to float in an upward air current and will tend to burn in suspension in the space above the fuel pile. Better regulated burning can be achieved by allowing as many of these shavings as possible to settle on to the fuel pile. For this reason, extreme turbulence in the area of the pile is not desirable.

b. Very Large Pieces

These are usually more of a physical handling problem rather than one of combustion.

a. Low Fuel Flow Rates

These require the same conditions as wet fuels, except that much less underfire air is required.

b. High Fuel Flow Rates

These tend to require similar measures as dry fuels. The two conditions can occur together and allowance must be made for this in the design.

In order to satisfy all the above requirements, applicant is proposing a number of modifications to the regular waste burner to improve combustion and so reduce smoke and particle emissions.

Applicant has found that control of the underfire air is not the most effective way of controlling the burner temperature and that such can be more efficiently done by proper control of the overfire air by means of draft modulated dampers.

As it is commonly known, gases expand as they heat and through this expansion they weight less for a given cubic volume than when cold. Also, hot gases tend to be replaced by the heavier cold gases with a force proportionate to their absolute temperature ratio, and this phenomenon is called natural draft. Based on this principle, it has been proposed to install, in air vents placed at the base of a burner, rotating dampers which respond to the natural draft pressure to control the overfire air.

It is therefore an object of the present invention to more effectively control burner temperature by using specially designed draft modulated dampers in the air vents which provide overfire air.

Another object of the present invention is the ducting of natural draft air within the burner to produce laminar air flow near the base of the burner and so minimize disturbance of the inside air.

Still another object of the present invention is to introduce overfire air at a high elevation in the burner using draft modulated or forced air vents for disturbing the vertical flow of the rising flame column with the object of providing better combustion turbulence and more burning time for particles being carried by the hot gases.

Still a further object of the invention is to provide centrifugal particulate separation near the top end of the burner so as to concentrate the heavy particles towards the outside perimeter of the burner and trap them so that they may fall back into the burner instead of going to the atmosphere.

The overfire draft system used in the present invention comprises air vents arranged circumferentially around the base of the burner for communicating the interior of the burner to the atmosphere and a draft modulated damper plate located in each air vent for automatically regulating the volume of overfire air delivered to the interior of the burner. The originally designed damper plates such as illustrated in the U.S. Pat. No. 3,848,551, issued Nov. 19, 1974, were flat and did not achieve adequate operating characteristics. It was found that it required far too much draft pressure to open them fully resulting in excessive temperatures in the burner. Attempts were made to overcome this problem by attaching adjustable counter weights to the shaft positioned so that the weight would be neutralized over the shaft with the damper closed. This weight would start to exert added opening torque as the damper moved to an open position, and this force would increase with increasing rotation of the damper. It was found, however, that unduly large weight masses were required for this, which in turn contributed to pivot bearing friction. This was no doubt aggravated by the construction of the damper itself, which, being a flat plate, was made of a heavier material. Also, it was found that in such a system very little gravity force remained to close the damper from the wide open position, making the system sensitive to bearing friction. Even if the balance and friction problems could possibly be solved, there remained the problem that these weights were subject to future misadjustment by well meaning but not always sufficiently skilled workers.

The above problem was solved, in accordance with the invention, by providing a draft modulated damper plate with a lower lip which is deflected by a predetermined angle with respect to the flat portion of the plate to create an aerodynamic lift effect with a large opening moment to assist the damper plate in its response under low air velocity conditions, and an oppositely deflected upper lip with proportionately less bent surface to avoid flutter or hunting of the damper plate as it approaches the maximum open position and to provide added dynamic opening force.

The lower lip occupies from 15% to 25%, preferably about 20% of the total damper surface while the upper lip occupies between 5% and 15%, preferably about 10% of the total damper surface.

A weight is preferably attached to the upper part of the damper plate, and the center of rotational movement of the damper plate, the mass of the damper plate and its attached weight, and the lip surfaces and deflection angles are arranged so that under each increment within the range of draft differential pressure across the damper plate, the net forces of draft acting to open the damper plate will be in equilibrium with the net forces of mass acting to close them when the angular open position thereof is such as to expose a functionally proportional cross-section to the air stream.

The angular deflection of the lips is preferably about 30° with respect to the main surface of the damper plate.

The overfire draft system, in accordance with a second feature of the present invention, further comprises duct means connected to such vents and oriented so as to direct air tangentially around the base of the burner and towards the lower inside wall of the burner so as to minimize the disturbance of the inside air.

The overfire draft system in accordance with a further object of the invention comprises draft modulated or forced air vents arranged circumferentially at mid-elevation around the burner, and duct means connected to such vents and directed at an angle with the radius of the burner so as to improve turbulence in the flame zone and reduce the vertical velocity of gases above the fire, thus reducing emission of particulate materials.

Finally, a lip portion may optionally be secured to the upper end of the burner and extend toward the center of the burner for trapping the heavy particles entrained by hot gases and concentrated around the outside perimeter of the burner by the centrifugal forces generated by the usual rotational motion of such hot gases.

The invention will now be disclosed, by way of example, with reference to a preferred embodiment illustrated in the accompanying drawings in which.

Figure 1:
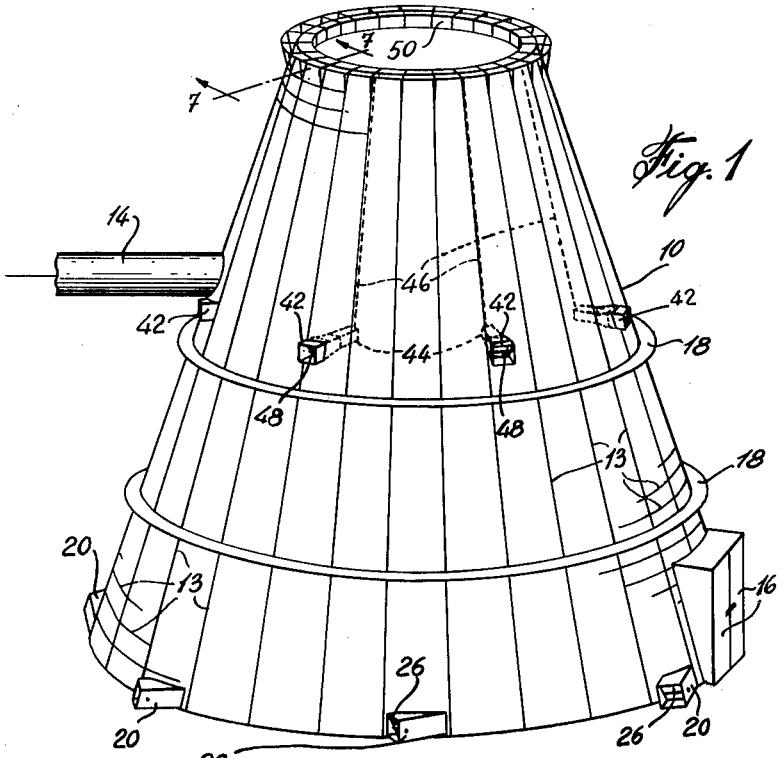
FIG. 1 illustrates an elevation view of a burner in accordance with the invention.
Figure 2:
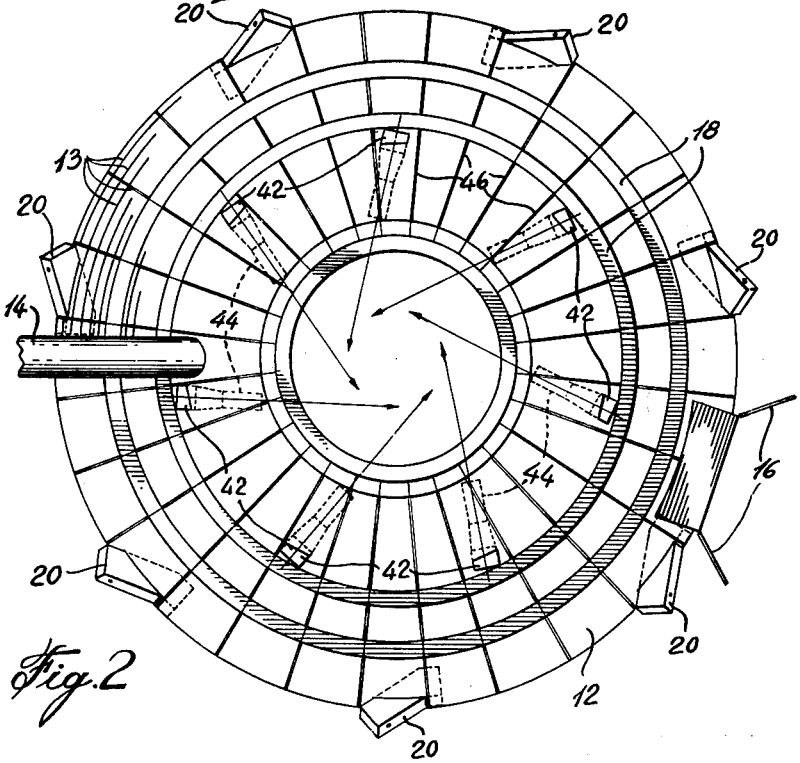
FIG. 2 illustrates a plan view of the burner of FIG. 1.

Referring to FIGS. 1 and 2, there is shown a typical waste burner having a shell 10 made up of a plurality of plates 12 secured to a supporting structure 13 so as to form a truncated cone. The burner is normally provided with a forced air underfire system (not shown) for directing primary combustion air into the interior of the burner through a grate structure (not shown) placed in a pit at the center of the burner as commonly known. Waste wood and bark residues are normally fed to the interior of the burner by a conveyor 14 and dumped on a waste pile formed on top of the grate structure. Doors 16 are also provided in the lower part of the shell 10 to provide access to the interior of the burner when needed. Service platforms or walkways 18 are also located at different elevations around the outside circumference of the shell 10.

Figure 3:
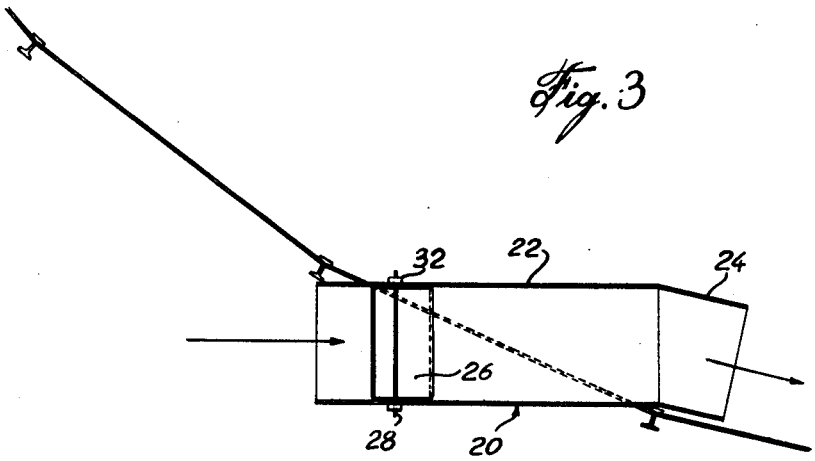
FIGS. 3 and 4 illustrate in more detail the air ducts located at the base of the burner.
Figure 4:
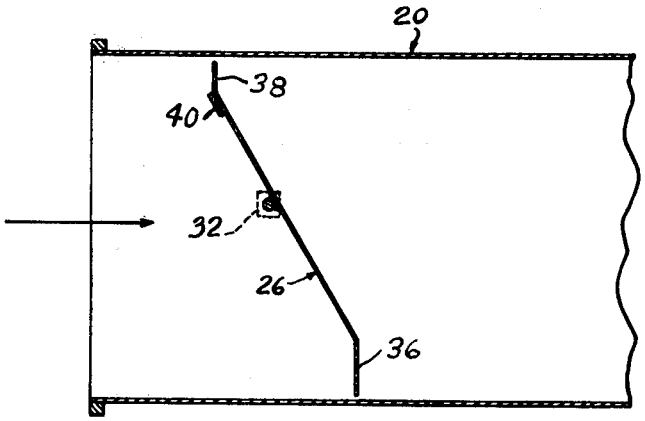
Figure 5:
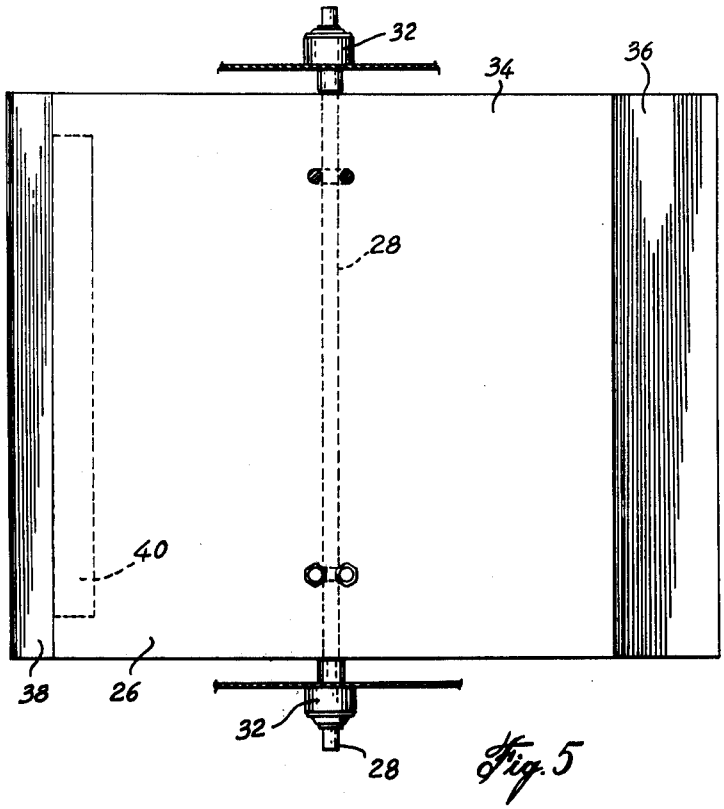
FIGS. 5 and 6 illustrate the damper plates used in the above air ducts.

A plurality of air boxes 20 are spaced circumferentially around the base of the burner and protrude through the lower plates of the shell. In the present embodiment of the invention, there are seven air boxes but it is to be understood that the number of air boxes varies with the air requirement and the size of the burner. These air boxes act as overfire air vents and are more clearly illustrated in FIGS. 3 and 4 of the drawings. Each air box consists of a first portion 22 which is inserted in an opening cut into the burner shell and a second portion 24 which is welded or otherwise secured to the first portion and oriented so as to direct the flow of air tangentially around the base of the burner. A damper plate 26 is pivotally mounted in portion 22 of the air box. As illustrated more clearly in FIGS. 5 and 6 of the drawings, damper plate 26 is secured to a shaft 28 by means of clamps 30 and shaft 28 is in turn rotatably mounted in bearings 32 secured to the walls of the air box.

Figure 6:
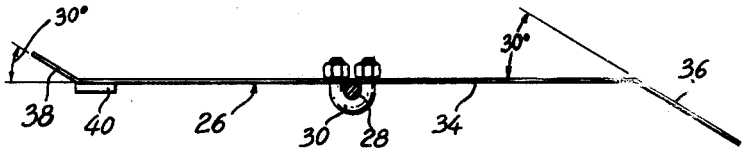

The damper plate 26 conforms to the shape of the air box which, in the present embodiment, is rectangular. However, it is to be understood that it could take various shapes. Each damper plate consists of a flat portion 34 and two oppositely bent portions, namely a lower lip portion 36 and an upper lip portion 38. The lower lip portion 36 occupies from 15% to 25%, preferably about 20%, of the total damper plate surface, and, as shown in FIG. 6 is deflected about 30° from the original flat plate. The above disclosed upper lip deflects passing air downward and in reaction to this tends to lift the damper. The lower lip also moves these reacting forces further from the shaft center than those of the flat plate, and this adds to the rotating forces. An advantage of this dynamic lift generation is that maximum dynamic lift is generated with a minimum of static (mechanical) materials. In this way it is possible to overcome the high weight factors that were noted with the flat damper plates used in the prior art, and it was also possible to retain more gravity forces for closing the damper at low draft levels.

To summarize the above, the lower lip 36 is a basic design for maximizing the dynamic forces tending to open the damper and maximization of these forces permits the use of the maximum possible gravity closing or counter balancing force in the design. The damper, therefore, responds positively and with relatively great force to any change in the draft pressure level. As these pressure levels in themselves are quite low, only a damper that is efficient will perform adequately in overcoming balance and bearing friction problems.

The upper lip portion 38 occupies between 5% and 15%, normally about 10% of the total damper surface and is preferably bent about 30° from the original flat plate. The above design avoids flutter or hunting of the damper plate as it approaches the maximum open position and provide added dynamic opening force. Indeed, as the upper edge of the damper plate becomes aligned with the air flow, a tendency could develop where small changes of position could cause large changes and reversals of the dynamic forces acting on the plate. The upper lip 38 adds stability to the damper by providing a "reversal of forces" point substantially different from that of the main plate of the damper. Since this "out of phase" portion of the damper is at its furthest extremety, it has a significant effect on the damper position. Furthermore, the profile of the upper lip 38 generates certain dynamic forces which might be called "downward aerodynamic lift" and tend to act in the same direction as the lift caused by the lower lip 36 thereby making the damper even more efficient.

It is to be understood that the upper and lower lips could be designed by the use of curved surfaces instead of the above illustrated sharp bends and the invention also includes the use of curved surfaces.

Furthermore, the above disclosed surface areas for lips 36 and 38 as well as the deflection angles hold for a damper designed to be fully open at a draft pressure of approximately 1 inch $H_2O$ and thus may change with changing design requirements.

Weight 40 is secured to the upper portion of the damper plate, and the center of rotational movement of the damper plate, the mass of the damper plate and its attached weight, and the lip surfaces and deflection angles are arranged so that under each increment within the range of draft differential pressure across the damper plate, the net forces of draft acting to open the damper plate will be in equilibrium with the net forces of mass acting to close it when the angular open position thereof is such as to expose a functionally proportional cross-section to the air stream.

Although a counter weight such as weight 40 is preferably associated with the damper design in accordance with the invention, this counter weight is calculated and forms a permanent feature of the damper as opposed to the adjustable counter weights of the prior dampers. Its purpose is to provide needed static forces to the damper system. Weights may also be placed on the lower portion of the damper plate as well as on the upper portion. These weights are usually placed to shift the center of gravity of the damper system to a different position as may be needed in the design.

The burner so far disclosed incorporates two main features of the invention, namely the use of improved draft modulated damper plates in air vents for providing overfire air, and the ducting of the air towards the lower inside wall of the burner so as to establish a laminar flow of cold air next to the shell of the burner.

With the improved draft modulated damper plates, the air flow rates vary with the draft levels and the air quantities per time period tend to be self-modulating. Because of this characteristic, the damper plates will tend to be closed when wet fuels are being burnt or when low fuel flow rates exist because the air inside the burner is cooler and, consequently, the natural draft lower as explained previously. Conversely, the damper plates will be wide open when dry fuels are being burnt or when high fuel flow rate exist because the air inside the burner is warmer and the natural draft higher. Furthermore, this self-regulating function is done without external control systems as the character of operation of the above disclosed damper plates is inherent in their design and balance. It is important to note that systems relying on external controls such as thermocouples and associated instrumentation to control the overfire air are subject to malfunction or failure which could cause damages to the burner and, more particularly, smoke and particle emissions. The installation and maintenance of such external control systems is also costly.

Ducting of the air towards the lower inside shell of the burner is also very important because, when very light fuels such as plain shavings are encountered, it is highly desirable to create as little turbulating an environment as possible so that these materials can settle onto the waste pile and burn. Cold air coming into the burner is heavier than the air already inside and to minimize the disturbance of the inside air, it has been found to be best that the incoming air be directed to where it would naturally tend to gravitate, this being towards the lower inside wall of the burner enclosure. This ducting of the air towards the lower inside wall of the burner enclosure also provides for a gradual rather than turbulent gravitation of this lower level air towards the center of the burner. This tends to confine the airborne particulate to the center of the burner leaving the perimeter floor of the burner cleaner. Without this feature, the burner floor is usually covered with ash or sawdust, which is carried by the turbulating air flow. Another advantage of the above ducting of the air towards the lower inside wall of the burner is that the coldest part of the air is held against the shell of the burner where it is most needed. Indeed, air is one of the best insulating material in existence and it keeps the shell of the burner cooler. Furthermore, this cold air, due to centrifugal action finds its most stable environment along the shell of the burner.

Returning now to FIGS. 1 and 2 of the drawings, air boxes 42 are spaced circumferentially at mid-elevation around the burner and ducts 44 are connected to such air boxes and extend towards the flame zone. The air boxes are cut through the shell of the burner and are secured thereto whereas the ends of the ducts 44 are suspended from the top of the burner by high carbon chains 46. The air boxes 42 and ducts 44 are oriented at a small angle with the radius of the burner so as to create turbulence in the flame zone and reduce the vertical velocity of gases above the fire as it will be discussed later. In the burner shown in FIGS. 1 and 2, there are seven air boxes 42 but it is to be understood that the number of air boxes depends on the air requirement and the size of the burner. A damper plate 48 is pivotally mounted in each air box. The shape of such damper plates is substantially the same as in the case of the lower dampers 26 except that they are designed to snap to fully open position when a predetermined draft is present rather than being opened on a proportionate basis as in the case of the lower dampers.

The main function of the mid-elevation draft modulated air boxes is to disturb the vertical flow of the rising flame column, with the object of providing better turbulence and more burning time for particles being carried by the hot gases. In other words, that portion of air which is introduced at this elevation reduces the vertical velocity of gases above the pile allowing less particle transport to the outside of the burner. As the area of this air introduction is higher up than that where fuel disturbance is a concern, maximum internal turbulence can be promoted at this point. When natural draft is not adequate to cause sufficient flame turbulence, forced air ducts could equally be used in place of natural draft ducts 44 or in addition thereto.

Figure 7:
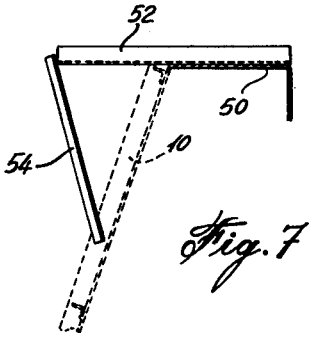
FIG. 7 illustrates the lip located at the upper portion of the burner.

Returning again in FIGS. 1 and 2, and as more clearly illustrated in FIG. 7, the upper part of the burner is open except for an L shaped lip 50 which is secured to the upper edge of the burner by braces 52 and 54 and forms a particle return plenum. Traditionally, the practice has been to contain particles within the burner by installing a screen over the top opening. This retains the large particles, but has very little effect on small particles such as granular sawdust, etc., which escape through the appropriate $\frac{1}{4}$ inch to $\frac{3}{8}$ inch square openings usual in such screens. As commonly known, a peculiar characteristic of the conical waste burner is that the hot rising gases tend to take on a rotating motion, which in the northern hemisphere is usually counterclockwise. The centrifugal forces generated by this rotational motion tend to concentrate the heavy particles carried by the hot gases towards the outside perimeter of the burner shell and such particles are trapped by lip 50 and returned to the interior of the burner. This reduces particle emission and is a valuable alternate to a screen installation. Indeed, the usual screen is difficult to maintain in good operating condition in the hot exit environment of the burner. In addition, without the screen, the opening area is increased and the reduced gas exit velocity is less likely to transport particles. Furthermore, the screen itself often acts to extinguish the flame and can thereby contribute to smoke emissions.

It has also been found that an exit gas velocity of approximately 1,100 ft/min at 800° F as it can be obtained with the above disclosed design, results in good characteristics. Too large an opening could, at low fuel flow rates, allow downward passage of cold air into the burner along the edge of the opening while simultaneously permitting upward flow of hot gases in the center.

Although the present invention has been disclosed with reference to a conical shaped waste burner, it is to be understood that it could be used with other types of waste burner. Therefore, the invention is not to be limited by the preferred embodiment disclosed.

What is claimed is:

1. For use with a waste burner which burns wastes at a base in the interior thereof, an overfire draft system comprising:
   a. air vents arranged circumferentially around the base of the burner for communicating the interior of said burner to the atmosphere; and
   b. a draft modulated damper plate located in each air vent for automatically regulating the volume of overfire air delivered to the interior of the burner, said draft modulated damper plate being provided with a lower lip which is deflected by a predetermined angle with respect to the plate to create an aerodynamic lift effect with a large opening moment to assist the damper plate in its response under low air velocity conditions, and an oppositely deflected upper lip with proportionately less bent surface to avoid hunting of the damper plate as it approaches the maximum open position and to provide added dynamic opening force.

2. An overfire draft system as defined in claim 1, wherein the lower lip occupies between 15% and 25% of the total damper plate surface.

3. An overfire draft system as defined in claim 2, wherein the lower lip occupies about 20% of the total damper plate surface.

4. An overfire draft system as defined in claim 1, wherein the upper lip occupies between 5% and 15% of the total damper plate surface.

5. An overfire draft system as defined in claim 4, wherein the upper lip occupies about 10% of the total damper plate surface.

6. An overfire draft system as defined in claim 1, wherein a counter weight is attached to said damper plate, and wherein the center of rotational movement of the damper plate, the mass of the damper plate and its attached weight, and the lip surfaces and deflection angles are arranged so that under each increment within the range of draft differential pressure across the damper plate, the net forces of draft acting to open the damper plate will be in equilibrium with the net forces of mass acting to close it only when the angular position thereof is such as to expose a functionally proportional cross-section of the air stream.

7. An overfire draft system as defined in claim 1, wherein the angular deflections of the lips are at about 30° with respect to the main surface of the damper plate.

8. An overfire draft system as defined in claim 1, wherein the interior of the furnace is defined by an inside wall having upper and lower regions and wherein said air vents are in the form of air ducts having a first portion protruding through the base of the burner and a second portion secured to said first portion and oriented so as to direct air tangentially around the base of the burner and towards the lower region of the inside wall so as to minimize the disturbance of the inside air.

9. For use with a waste burner which burns wastes as a base in an interior defined by an inside wall, an overfire draft system comprising:
   a. draft modulated vents arranged circumferentially around the base of the burner; and
   b. duct means connected to said vents and oriented tangentially along the inside wall of the burner at the point of entry into the burner and toward the lower inside wall of the burner so as to direct a laminar flow of air tangentially around the base of the burner and towards the lower inside wall of the burner so as to minimize the disturbance of the inside air.

10. An overfire draft system as defined in claim 9, wherein damper plates are located in each vent, each damper plate being provided with a lower lip which is deflected by a predetermined angle with respect to the plate to create an aerodynamic lift effect with a large opening moment to assist the damper plate in its response under low air velocity conditions, and an oppositely deflected upper lip with proportionately less bent surface to avoid hunting of the damper plate as it approaches the maximum open position and to provide added dynamic opening force.

11. An overfire draft system as defined in claim 10, wherein the lower lip occupies between 15% and 25% of the total damper plate surface.

12. An overfire draft system as defined in claim 11, wherein the lower lip occupies about 20% of the total damper plate surface.

13. An overfire draft system as defined in claim 10, wherein the upper lip occupies between 5% and 15% of the total damper plate surface.

14. An overfire draft system as defined in claim 13, wherein the upper lip occupies about 10% of the total damper plate surface.

15. An overfire draft system as defined in claim 10, wherein a counter weight is attached to the damper plate and wherein the center of rotational movement of the damper plate, the mass of the damper plate and its attached weight, and the lip surfaces and deflection angles are arranged so that under each increment within the range of draft differential pressure across the damper plate, the net forces of draft acting to open the damper plate will be in equilibrium with the net forces of mass acting to close it only when the angular open position thereof is such as to expose a functionally proportional cross-section of the air stream.

16. An overfire draft system as defined in claim 10, wherein the angular deflections of the lips are at about 30° with the main surface of the damper plate.

17. An overfire draft system as defined in claim 1, further comprising:
   a. air vents arranged circumferentially at mid-elevation around the burner; and
   b. duct means connected to said vents and directed at a small angle with the radius of said burner so as to improve turbulence in the flame zone and reduce the vertical velocity of gases above the fire, thus reducing emission of particulate materials.

18. An overfire draft system as defined in claim 17, wherein a damper plate is positioned in each vent, said damper plate being provided with a lower lip which is deflected by a predetermined angle with respect to the plate to create an aerodynamic lift effect with a large opening moment to assist the damper plate in its response under low air velocity conditions, and an oppositely deflected upper lip with proportionately less bent surface to avoid hunting of the damper plate as it approaches the maximum open position and to provide added dynamic opening force.

19. An overfire draft system as defined in claim 18, wherein a counter weight is attached to the damper plate, and wherein the center of rotational movement of the damper plate, the mass of the damper plate and its attached weight, and the lip surfaces and deflection angles are arranged so that the damper plate will snap open when a predetermined draft is present.

20. An overfire draft system as defined in claim 19, wherein the angular deflections of the lips are at about 30° with the main surface of the damper plate.

21. An overfire draft system as defined in claim 1, wherein said burner has an upper end opposite from the base and an intermediate center, and further comprising a lip portion secured to the upper end of said burner and extending toward the center of the burner for trapping the heavy particles entrained by hot gases and concentrated around the outside perimeter of the burner by the centrifugal forces generated by the rotational motion of said hot gases.

* * * * *